US006817489B2

(12) United States Patent
Cabarroque et al.

(10) Patent No.: US 6,817,489 B2
(45) Date of Patent: Nov. 16, 2004

(54) FLUID DISPENSER DEVICE

(75) Inventors: Xavier Cabarroque, Le Kremelin-Bicetre (FR); Fabien Poulard, Rouen (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 10/414,035

(22) Filed: Apr. 16, 2003

(65) Prior Publication Data

US 2003/0197025 A1 Oct. 23, 2003

Related U.S. Application Data

(60) Provisional application No. 60/382,045, filed on May 22, 2002.

(30) Foreign Application Priority Data

Apr. 17, 2002 (FR) ..... 02 04810

(51) Int. Cl.[7] ..... B05O 11/00

(52) U.S. Cl. ..... 222/162; 222/168; 222/381; 222/384

(58) Field of Search ..... 222/153.01, 153.11, 222/153.13, 153.14, 162, 167–169, 381, 384

(56) References Cited

U.S. PATENT DOCUMENTS 5,465,873 A 11/1995 Mejean et al.
2004/0026453 A1 * 2/2004 Cabarroque et al. ... 222/153.13

FOREIGN PATENT DOCUMENTS

FR 2 750 406 1/1998
WO WO 01/03851 A1 1/2001

* cited by examiner

*Primary Examiner*—J. Casimer Jacyna
(74) *Attorney, Agent, or Firm*—Sughrue Mion, PLLC

(57) ABSTRACT

A manually-actuated device for dispensing a fluid in liquid or powder form and that comprises a fluid reservoir (10), dispensing means (20) for selectively dispensing the fluid contained in the reservoir (10), a dispensing head (30) provided with a dispensing orifice (31), and an actuating system (40) for manually actuating said dispensing means (20), said device being provided with a captive cap (50) mounted to move between a rest position, in which it covers the dispensing orifice (31) and prevents the dispensing means (20) from being actuated, and an in-use position, in which it uncovers the dispensing orifice (31) and enables the dispensing means (20) to be actuated, characterized in that said cap (50) is part of said actuating system (40), said cap (50) actuating said dispensing means (20) by being moved towards its in-use position.

5 Claims, 3 Drawing Sheets

FLUID DISPENSER DEVICE

CROSS REFERENCE TO RELATED APPLICATION

This application claims the benefit under 35 U.S.C. §119 (e) of pending U.S. provisional patent application Ser. No. 60/382,045, filed May 22, 2002, and priority under 35 U.S.C. §119(a)–(d) of French patent application No. FR-02.04810, filed Apr. 17, 2002.

TECHNICAL FIELD

The present invention relates to a manually-actuated device for dispensing fluids in liquid or powder form.

BACKGROUND OF THE INVENTION

A liquid or powder dispenser device, in particular for dispensing fluids in the fields of pharmaceuticals, cosmetics, perfumes or the like, generally comprises a fluid reservoir, a dispensing member, such as a pump, for dispensing the fluid contained in the reservoir, and a dispensing head incorporating a dispensing orifice. An actuating system is generally also provided for actuating said pump. A problem that can arise with liquid or powder dispenser devices of this type relates to the period of time that elapses between the end of the device being assembled, and the occasion on which the user actually uses it. During that time lapse, it is necessary to prevent the dispensing orifice from becoming clogged or soiled, and to prevent the device from being actuated accidentally. Those problems are generally solved by providing a removable cap on the dispensing head, and a system for locking the device, which system prevents any accidental actuation of the device. For example, that may be achieved by means of a break-off strip or by means of a latch element to be moved out of the way prior to use. Although such systems are effective, they suffer from some drawbacks. The removable cap might be lost when it is removed from the dispensing head, so that the problem of the dispensing orifice becoming clogged can then arise after the first occasion on which the device is used, e.g. when the dispenser device is to be carried about in a handbag or the like. Similarly, safety systems for preventing the device from being actuated accidentally while it is being stored or carried can be complex and therefore costly to make, and they are not always entirely reliable.

BRIEF SUMMARY OF THE INVENTION

An object of the present invention is to provide a liquid or powder dispenser that does not suffer from the above-mentioned drawbacks.

An object of the present invention is thus to provide a liquid or powder dispenser that protects the dispensing orifice and that simultaneously prevents the device from being actuated at any time in the periods during which the device is not in use.

Another object of the present invention is to provide a liquid or powder dispenser device that is simple and inexpensive to manufacture and to assemble, and that is easy to use.

The present invention thus provides a manually-actuated device for dispensing a fluid in liquid or powder form and that comprises a fluid reservoir, dispensing means for selectively dispensing the fluid contained in the reservoir, a dispensing head provided with a dispensing orifice, and an actuating system for manually actuating said dispensing means, said device being provided with a captive cap mounted to move between a rest position, in which it covers the dispensing orifice and prevents the dispensing means from being actuated, and an in-use position, in which it uncovers the dispensing orifice and enables the dispensing means to be actuated, said cap being part of said actuating system, said cap actuating said dispensing means by being moved towards its in-use position.

Advantageously, said cap is moved over two distinct paths to go from its rest position to its in-use position.

Advantageously, said cap moves in radial translation to uncover the dispensing orifice and then in axial translation to actuate the dispensing means.

Advantageously, said dispensing means are implemented in the form of a pump that is actuated manually.

BRIEF DESCRIPTION OF THE DRAWINGS

Other characteristics and advantages of the present invention will appear more clearly on reading the following detailed description of one embodiment of the invention, given with reference to the accompanying drawings which are given by way of non-limiting example, and in which.

DETAILED DESCRIPTION

Figure 1:
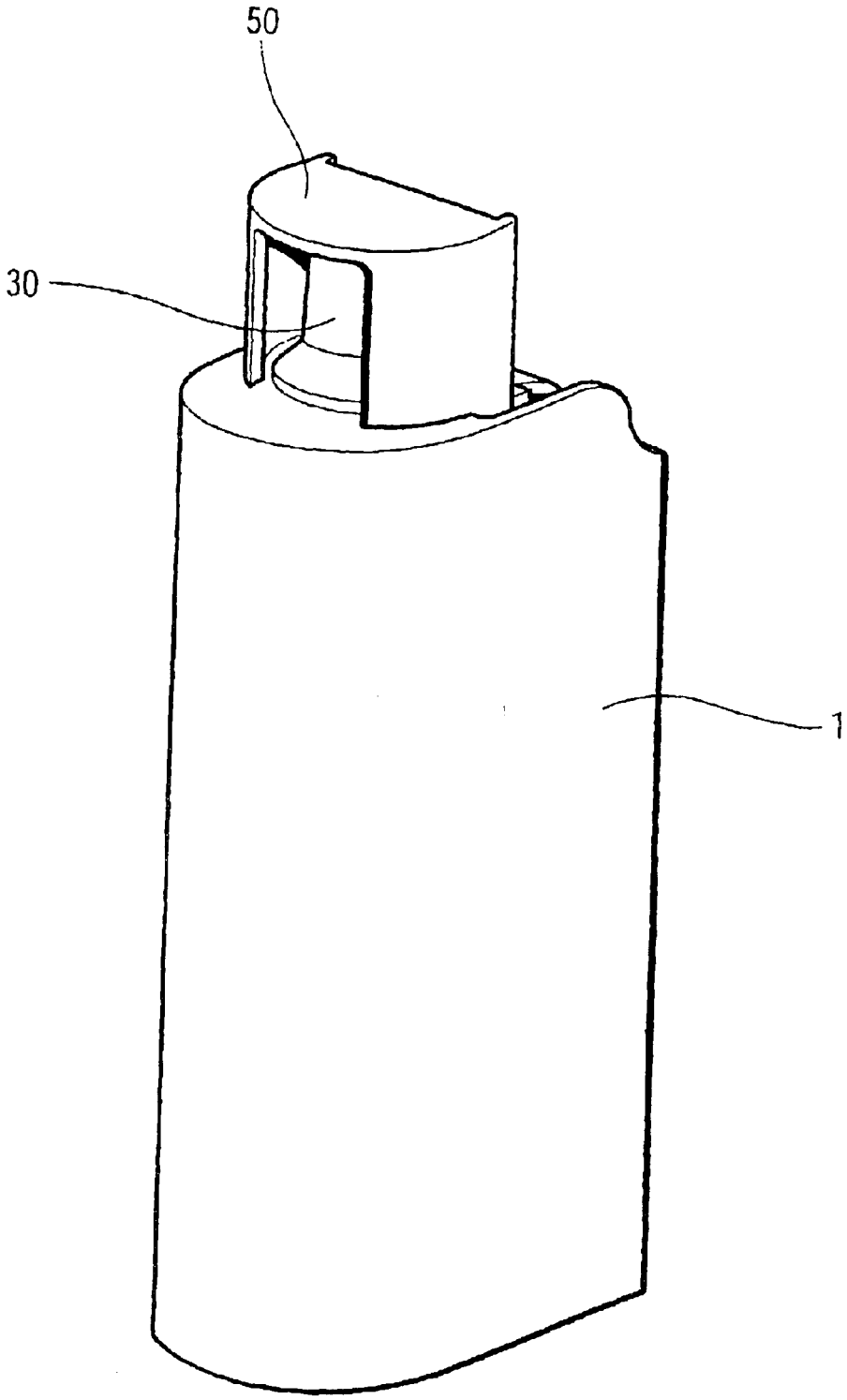
FIG. 1 is a diagrammatic perspective view of a liquid or powder dispenser device in a first embodiment of the invention, with the cap in a rest position.

With reference to the Figures, the device of the invention for dispensing a fluid in liquid or powder form comprises a fluid reservoir 10 on which a dispensing pump 20 is assembled, the dispensing pump itself being connected to a dispensing head 30 provided with a dispensing orifice 31. An actuating system 40 is provided for actuating said pump 20. In the invention, the device includes a captive cover 50 which is mounted to move between a rest position (shown in FIG. 1) in which it covers the dispensing orifice 31 and prevents the pump 20 from being actuated, and an in-use position (shown in FIG. 3) in which it uncovers the dispensing orifice 31 and enables the pump 20 to be actuated.

Figure 2:
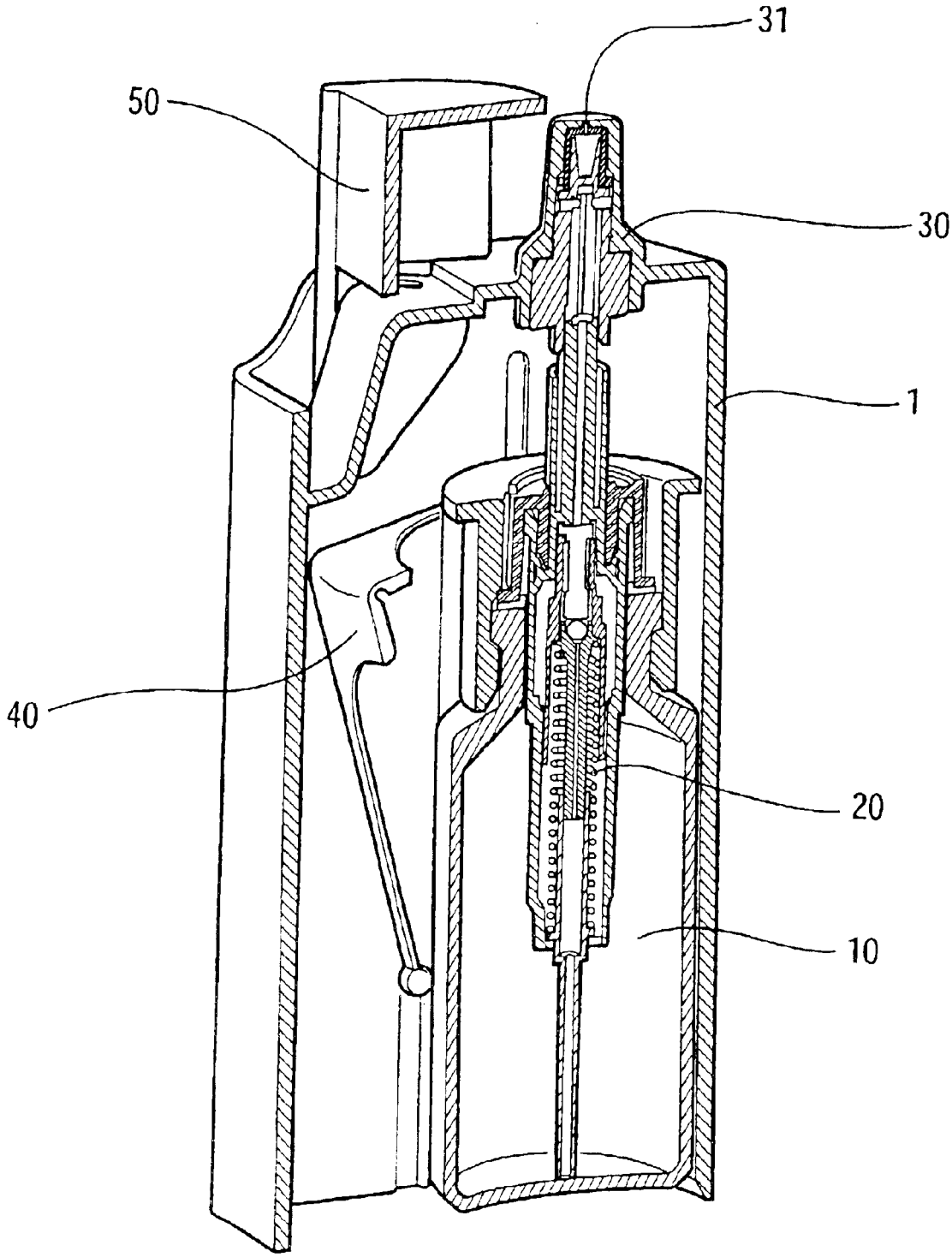
FIG. 2 is a partially cut-away diagrammatic perspective view of the device of FIG. 1, with the cap in an intermediate position.
Figure 3:
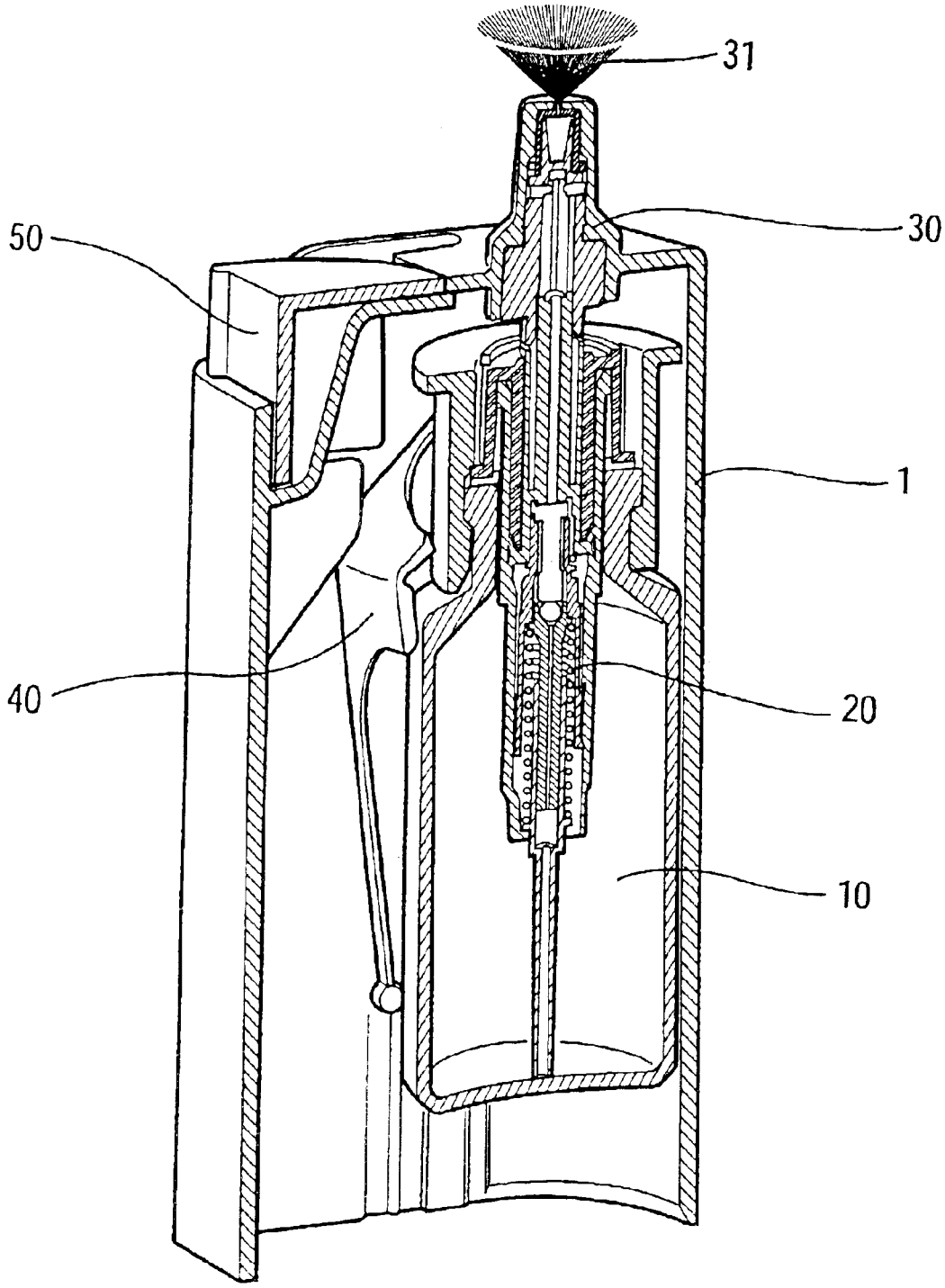
FIG. 3 is a view similar to the view of FIG. 2, with the cap in an in-use position.

FIGS. 1 to 3 show an advantageous embodiment of the present invention. The cap 50 is part of the actuating system 40 in that, by moving towards its in-use position, the cap 50 causes the pump 20 to be actuated. Therefore, when the cap 50 is in the rest position, it is impossible to actuate the pump 20, it being necessary for the user to move said cap 50 into its in-use position in order to actuate said pump. Advantageously, as shown in the figures, the cap 50 may be organized such that it moves along two different paths to go from its rest position to its in-use position. More precisely, the example shown shows a cap 50 that moves in radial translation to uncover the dispensing orifice 31, as shown in FIGS. 1 and 2, then in axial translation under the effect of the user pushing on the cap to actuate the pump 20. As can be observed in FIG. 3, the cap 50 being moved axially between the position shown in FIG. 2 and the position shown in FIG. 3 causes the actuating system 40 to be actuated, thereby causing a metered quantity or "dose" of fluid to be dispensed through the dispensing orifice 31. Naturally, the cap 50 may move in different ways to go from its rest position to its in-use position, e.g. in rotation or in a combination of rotation and of translation.

The cap 50 may include resilient return means that return it to its rest position after the device has been used. In a variant, it is possible to imagine that the user manually returns said cap to its rest position. Moreover, the invention is described above with reference to a liquid or powder dispenser device in which the dispensing direction is axial relative to the central axis of the pump and of the reservoir, but it is equally applicable to all types of dispenser device, and in particular to those that include a dispensing head having a radial dispensing direction. Furthermore, although the present invention is particularly well suited to liquid or powder dispenser devices having side actuating systems, it is not limited to this type of system, and indeed it is applicable to all suitable types of actuating system.

Although the invention is described above with reference to a particular embodiment of it, it is to be understood that it is not limited to this embodiment, and that the person skilled in the art may make any appropriate modifications without going beyond the ambit of the present invention as defined in the accompanying claims.

What is claimed is:

1. A manually-actuated device for dispensing a fluid in liquid or powder form and that comprises a fluid reservoir (10), dispensing means (20) for selectively dispensing the fluid contained in the reservoir (10), a dispensing head (30) provided with a dispensing orifice (31), and an actuating system (40) for manually actuating said dispensing means (20), said device being provided with a captive cap (50) mounted to move between a rest position, in which it covers the dispensing orifice (31) and prevents the dispensing means (20) from being actuated, and an in-use position, in which it uncovers the dispensing orifice (31) and enables the dispensing means (20) to be actuated, wherein said cap (50) is part of said actuating system (40), said cap (50) actuating said dispensing means (20) by being moved towards its in-use position; and wherein said can (50) is moved over two distinct paths to go from its rest position to its in-use position.

2. A device according to claim 1, in which said cap (50) moves in radial translation to uncover the dispensing orifice (31) and then in axial translation to actuate the dispensing means (20).

3. A device according to claim 1, in which said dispensing means (20) are implemented in the form of a pump that is actuated manually.

4. A manually-actuated device for dispensing a fluid in liquid or powder form and that comprises a fluid reservoir, a dispenser that dispenses fluid contained in the reservoir, a dispensing head provided with a dispensing orifice, and an actuating system that manually actuates the dispenser, the device further comprising a captive cap mounted to move between a rest position, in which the cap covers the dispensing orifice and prevents the dispenser from being actuated, and an in-use position, in which the cap uncovers the dispensing orifice and enables the dispenser to be actuated, wherein the cap is part of the actuating system, the cap actuating the dispenser by being moved towards the in-use position; and wherein the cap is moved over two distinct paths to go from the rest position to the in-use position.

5. The device according to claim 4, wherein the cap moves in radial translation to uncover the dispensing orifice and then in axial translation to actuate the dispenser.

* * * * *